US005799827A

United States Patent [19]

D'Andrade

[11] Patent Number: 5,799,827

[45] Date of Patent: Sep. 1, 1998

[54] BLADDER WATER GUN

[76] Inventor: Bruce M. D'Andrade, 3 Ten Eyck Rd., Whitehouse Station, N.J. 08889

[21] Appl. No.: 672,941

[22] Filed: Jun. 28, 1996

[51] Int. Cl.[6] ..... A63H 33/00

[52] U.S. Cl. ..... 222/79; 222/401; 222/212; 446/473; 417/474; 92/90

[58] Field of Search ..... 222/79, 401, 206, 222/209, 212; 446/405, 473; 417/412, 472, 474; 92/90, 93

[56] References Cited

U.S. PATENT DOCUMENTS

| | | | |
|---|---|---|---|
| 600,552 | 3/1898 | Parker | 222/79 |
| 605,430 | 6/1898 | Humphrey | 222/79 |
| 617,495 | 1/1899 | Reimann | 222/79 |
| 688,882 | 12/1901 | Parker | 222/79 |
| 1,629,019 | 5/1927 | Cohn | 222/79 |
| 2,159,894 | 5/1939 | Hines | 222/79 |
| 2,237,678 | 4/1941 | Lohr et al. . | |
| 2,527,614 | 10/1950 | Arpin | 222/79 |
| 2,629,516 | 2/1953 | Badham | 222/79 |
| 3,302,318 | 2/1967 | Black | 222/79 |
| 3,486,539 | 12/1969 | Jacuzzi . | |
| 4,135,559 | 1/1979 | Baraby . | |
| 4,212,460 | 7/1980 | Kraft . | |
| 4,257,460 | 3/1981 | Paranay et al. | 141/26 |
| 4,458,830 | 7/1984 | Werding . | |
| 4,733,799 | 3/1988 | Wiskur | 222/79 |
| 4,735,239 | 4/1988 | Salmon et al. | 141/25 |
| 4,854,480 | 8/1989 | Shindo | 222/79 |
| 4,892,081 | 1/1990 | Moormann . | |
| 4,991,847 | 2/1991 | Rudell et al. . | |
| 5,150,819 | 9/1992 | Johnson et al. | 222/79 |
| 5,366,108 | 11/1994 | Darling | 222/79 |
| 5,373,833 | 12/1994 | D'Andrade . | |
| 5,529,525 | 6/1996 | Deal | 446/473 |
| 5,531,626 | 7/1996 | Deal | 446/473 |
| 5,531,627 | 7/1996 | Deal | 446/473 |
| 5,538,457 | 7/1996 | Deal | 446/473 |

*Primary Examiner*—J. Casimer Jacyna

*Attorney, Agent, or Firm*—Kenneth P. Glynn, Esq.

[57] ABSTRACT

The present invention is an expandable bladder toy water gun. It includes a main housing having a barrel and water ejection nozzle, a handle and a trigger, as well as an inflatable bladder connected to the main housing, the bladder having an inlet and an outlet. There is also a storage tank for supplying water thereto, as well as a hand pump connected to both the storage tank and the bladder. The pump is physically connected to the housing and functionally connected to the storage tank and the bladder inlet. There is a bladder release valve having an upstream side and a downstream side, and it is connected to the bladder outlet at the valve's upstream side, and is connected to the trigger for opening and closing thereof, and is connected to the nozzle at the valve's downstream side for subsequent water ejection when the trigger is pulled.

28 Claims, 7 Drawing Sheets

BLADDER WATER GUN

BACKGROUND OF THE INVENTION

1. Field of the Invention

The present invention is directed to expandable bladder toy water guns. More specifically, the toy water gun of the present invention relies upon a "pressurizable" bladder for release of water wherein the water is first stored in a fill tank and is then pumped into the bladder and expands the bladder for pressurized bladder containment of the water until subsequent trigger release. In some embodiments, the nozzle has an apparent diameter of at least one eighth of an inch to create a shotgun burst of water.

2. Information Disclosure Statement

The following patents represent development in bladder-containing toy guns (air and water) as well as other water guns:

U.S. Pat. No. 5,373,833 to D'Andra de describes a projectile-shooting air gun. It includes a main housing which has a barrel adapted for receiving a projectile, a handle and a trigger, as well as a high pressure, inflatable bladder connected to the main housing, the bladder has an inlet and an outlet. There is also a pressurizing mechanism for providing air pressure to the bladder to inflate it. The pressurizing mechanism is physically connected to the housing and functionally connected to the bladder inlet. There is a bladder deflation valve which is connected to the trigger for opening and closing thereof, and it is connected to a projectile launch tube for launching a projectile upon deflation of at least a portion of the bladder. The launch tube is located in the barrel of the main housing and connected to the bladder deflation valve, and adapted for receiving and shooting a projectile.

U.S. Pat. Nos. 4,991,847 and 4,890,838 to Rudell et al. both describe a timed water release toy. There is disclosed a ball having a foraminous outer shell with an inner membrane which forms an interior closure within the outer shell and with a timer and a release mechanism operative to open the inner membrane and release its contents after the time on the timer expires. The contents spill through the foraminous outer shell, wetting the player who is handling or catching the ball at the moment of release. The timer is activated and the ball is used in a game in which it is tossed between participants who seek to avoid becoming wet when the timer releases the water from the interior closure of the ball.

U.S. Pat. No. 4,892,081 Randall Morrmann sets forth a compressible ball launcher which relies upon a telescoping cylindrical gun to compress water to force a ball out of a nozzle.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,735,239 to Salmon et al. describes a liquid projecting device. The device uses an elastic tubular bladder for receiving liquid which is expandable radially generally spherically at a local segment until a fully-expanded cross-section is achieved at which time the expanded region begins to grow axially, thereby maintaining a relatively constant pressure independent of bladder volume. The device is provided with a nozzle and a valve for controlling and directing the flow of the projected liquid.

U.S. Pat. No. 4,458,830 to Werding describes an appliance for discharging a non-compressible liquid, creamy or pasty product under pressure. The container of rigid material comprises an appliance which employs the contractional force of an expanded rubber hose and an expanded product container for the discharge of a medium stored therein. A hollow body of elastic material located in the axis of a product container is provided with a valve at one end through which it is inflated. The shape of the inner walls for the rigid container limits a radial, diagonal-radial and axial expansion of the appliance in a predetermined ratio, whereby the medium acts upon the inflated hollow body in such a way that the volume of the latter decreases, whereby its inner pressure increases and gives it a tendency to expand. If the squeezing pressure exerted by the rubber hose and the product container upon the medium decreases, the hollow body can expand accordingly and thus compensate the loss of contraction pressure.

U.S. Pat. No. 4,257,460 to Paranay et al. describes a water gun. The novel water gun is disclosed herein having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body, and a trigger mechanism may be employed for selectively releasing the pressurized water within the storage compartment.

U.S. Pat. No. 4,212,460 to Kraft describes a hollow water-filled game toy. The hollow body is provided having two complementary parts releasably joined about interfitting rim portions. When the parts are joined, the hollow body may be compressed to partially deform a portion of the rim structure into an opening thereby allowing the filling of water into the body interior. After deformation the parts resume their original shape. An effective hermetic seal to retain the water within the interior is formed by squeezing the body and purging water through the vents in the rim portions. The water-filled body may then be thrown against a stationary object whereby the force of impact will release the seal and allow the water to become suddenly released causing a splashing action. The complementary hollow parts may be subsequently rejoined and refilled with water to repeat the throwing and splashing action.

U.S. Pat. No. 4,135,559 to Barnby describes a water squirt toy and fill valve combination. The water squirt toy apparatus includes a combination of a water squirt toy and a special filling valve which function together cooperatively. The water squirt toy includes a resiliently expansible tubular member serving as a water reservoir and encased within a rigid tubular support member, and a manually operated, lever-type, normally closed valve mechanism operatively associated with the expansible member for permitting or preventing fluid discharge therefrom by compressing or pinching the same. The frontward end of the expansible member is fixedly, but removably, secured to a discharge opening. The filling valve is particularly structured for fluidically mating with a conventional hose bib or hose as well as with the discharge opening in order to permit easy and rapid filling and refilling of the expansible member with water. The discharge opening may also mate directly with the hose bib or hose without the special valve. An injector is also provided for operative connection to the filling valve for injecting chemicals in to the water supply whereby the discharged streams will coalesce and exhibit reduced separation so as to be discharged over significantly greater distances; and amusement apparatus which is particularly adaptable for use with the water squirt toy is also disclosed. A weakened annular portion of the tubular member is utilized to insure that the expansion begins frontward and progresses rearwardly.

U.S. Pat. No. 3,486,539 to Candido Jacuzzi describes a liquid dispensing and metering assembly. The liquid dispensing and is metering assembly in which an expansible receptacle of a material adapted to maintain constant pressure characteristics over a substantial change in volume of liquid content of such receptacle, discharges through a slow rate metering-element to provide a uniform discharge flow at a low constant pressure.

U.S. Pat. No. 2,237,678 issued to Raymond Lohr et al describes a repeating, cork shooting toy which utilizes a cork magazine which rotates after each firing to position the next cork in sequence for firing.

Notwithstanding the foregoing, the prior art neither teaches nor suggests the use of an expanded bladder, pumped up by a pump on a toy water gun from a tank, to release subsequent water, as in the present invention.

SUMMARY OF THE INVENTION

The present invention is an expandable bladder toy water gun. It includes a main housing having a barrel and water ejection nozzle, a handle and a trigger, as well as an inflatable bladder connected to the main housing, the bladder having an inlet and an outlet. There is also a storage tank for supplying water thereto, as well as a hand pump connected to both the storage tank and the bladder. The pump is physically connected to the housing and functionally connected to the storage tank and the b ladder inlet. There is a bladder release valve having an upstream side and a downstream is side. The bladder release valve is connected to the bladder outlet at the valve's upstream side, and is connected to the trigger for opening and closing thereof, and is connected to the nozzle at the valve's downstream side for subsequent water ejection when the trigger is pulled. In preferred embodiments, the bladder has a predetermined expansion size to which it is capable of being expanded, and an enclosure is provided around the bladder, which is a size less than the predetermined expansion size to enhance a controlled expansion of the bladder during filling. In other preferred embodiments, the nozzle can have an extremely large diameter for a water gun, three eighths of an inch or larger, to create a shotgun type burst of water.

BRIEF DESCRIPTION OF THE DRAWINGS

The present invention is more fully understood when the present specification is taken in conjunction with the drawings appended hereto, wherein.

DETAILED DESCRIPTION OF THE PRESENT INVENTION

The present invention toy water gun has been developed to provide high powered, safe shooting of water, while being fully self-contained, i.e. without the need for pressurized gas canisters or batteries or external pressurizing means such as pressurized water from a garden hose or faucet. The toy water gun of the present invention also provides relatively constant pressure throughout the duration of the shot. It relies upon manual pumping to fill a bladder with water which will store the water under pressure created by elastic bladder expansion for subsequent firing. In some preferred embodiments, a significantly large nozzle opening is provided to achieve the aforesaid shotgun effect. This nozzle can have an extremely large diameter compared to all prior known water guns, the diameter being about three eighths of an inch or larger.

Figure 1:
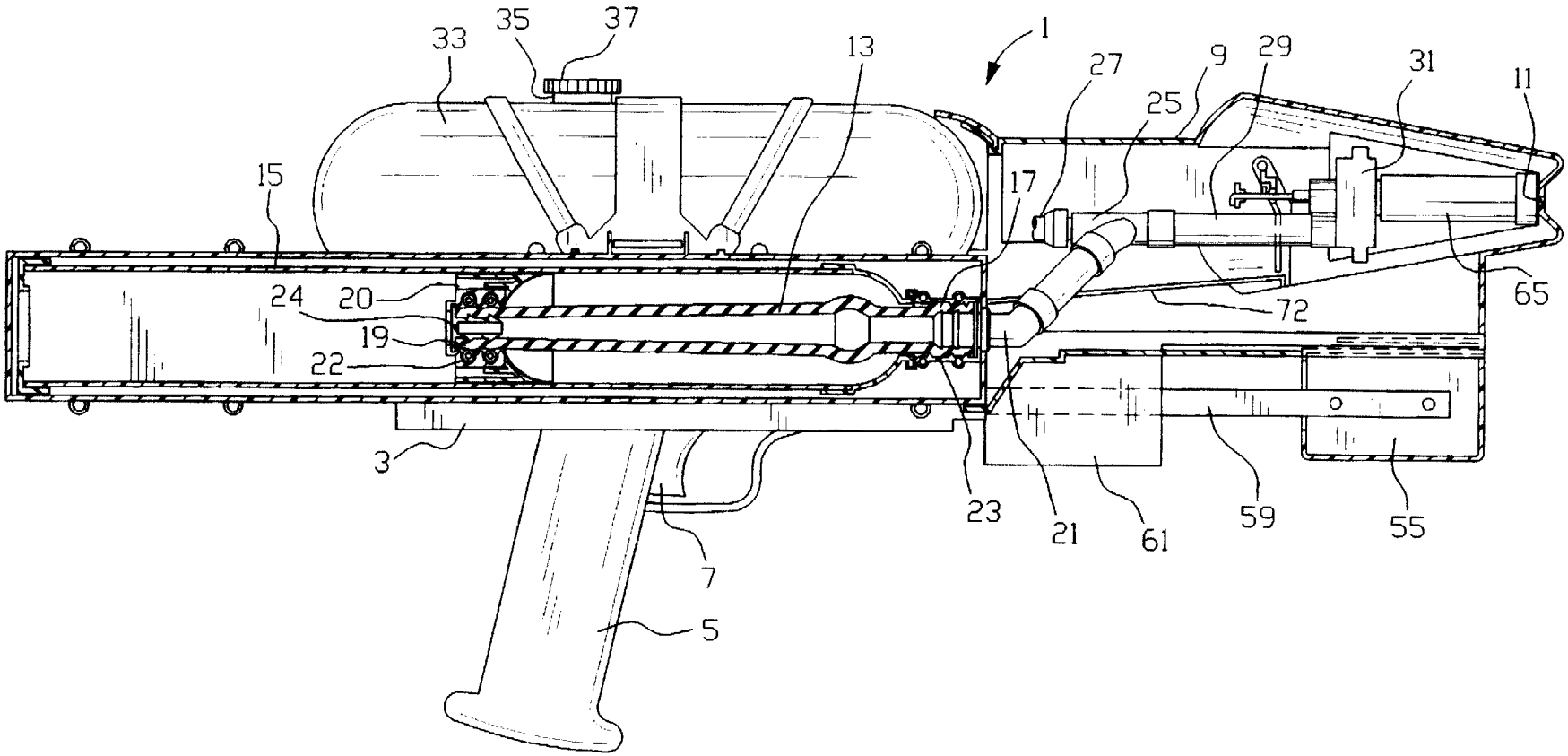
FIG. 1 shows a side cut view of a present invention toy water gun.

Referring now to FIG. 1, the operation of the present invention embodiment can best be explained. FIG. 1 is a side view of the present invention embodiment toy water gun 1 with main housing 3, handle 5, trigger 7 and barrel 9 with nozzle 11.

Bladder 13 is located within enclosure 15. Bladder 13 has a front end 17 and back end 19 and is cylindrical, but could be of another shape and not exceed the scope of the present invention. Front end 17 acts both as an inlet and an outlet in this embodiment, but the water gun could be configured so that back end 19 acts as the outlet or vice versa. Back end 19 includes clamp 22 and also includes bladder carriage 20 surrounding clamp 22. Clamp 22 holds plug 24 in the back end 19 of bladder 13 and connects back end 19 of bladder 13 to bladder carriage 20. Bladder carriage 20 moves towards the back of the gun as bladder 13 is expanded (filled) and moves back to its rest position (shown in FIG. 1) during release of the bladder. Front end 17 has tube 21 connected thereto via clamp 23. Tube 21 is connected to a "y" connection 25 which is connected to tube 27, which is connected to a pump, described below. Connection 25 is also connected to tube 29 which is connected to a bladder release valve 31, discussed below.

Figure 2:
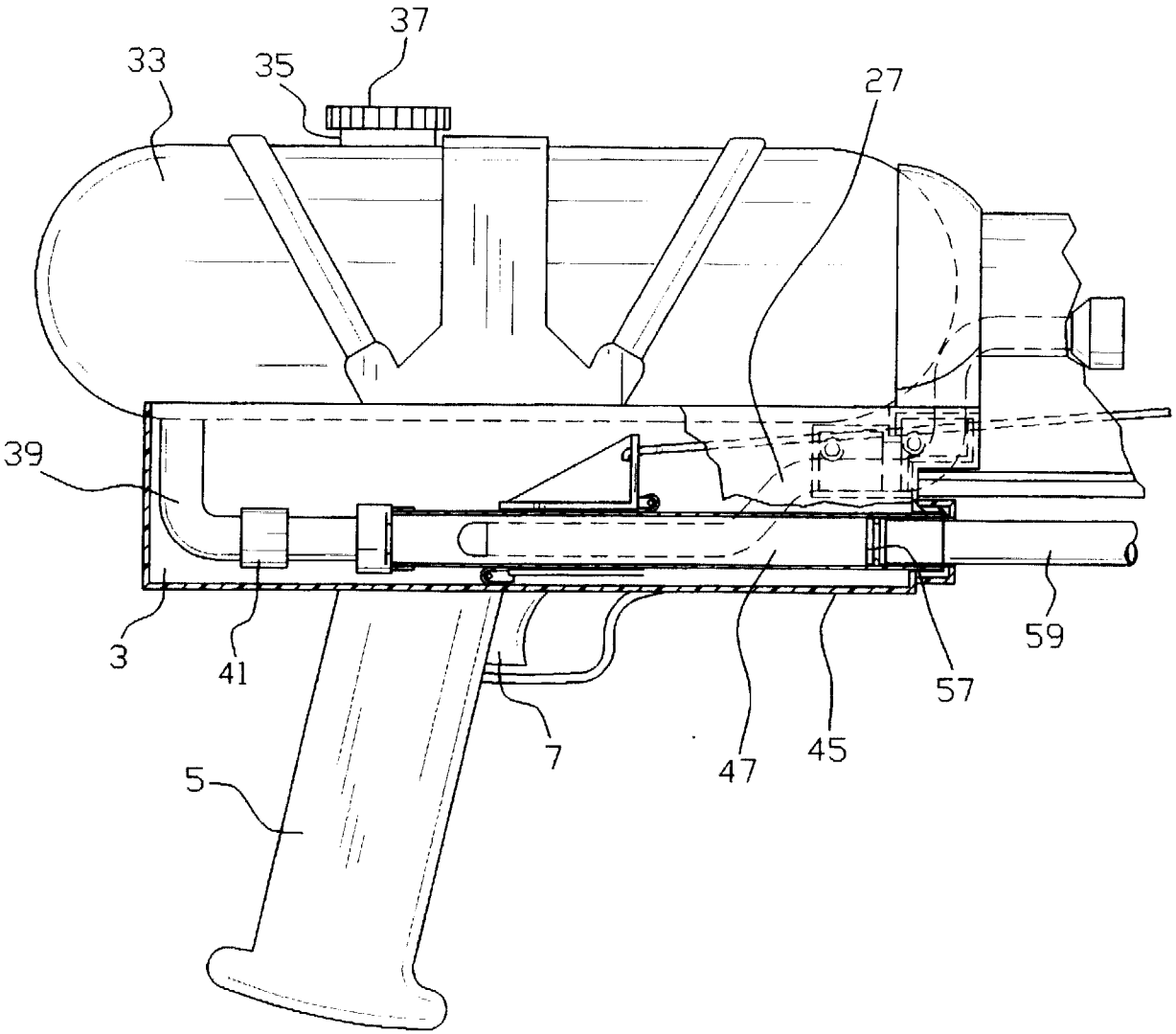
FIG. 2 shows a partial side cut view of the present invention toy water gun shown in FIG. 1 with the bladder removed for presentation of the pump.

The operation of present invention toy water gun 1 is illustrated by reference to both FIGS. 1 and 2 simultaneously, with identical parts for both figures being identically numbered. FIG. 2 shows a partial side cut view, with the bladder 13 and related housing removed to show pump 45 and its operation. Toy water gun 1 is operated by filling or partially filling tank 33 with water through fill port 35 after removal of cap 37. Tank 33, as shown, is connected to water gun main housing 3, as shown. By "connected" is meant physically or fluidly connected to the gun directly or indirectly or internally contained therein or integrally formed therewith. Cap 37 has a small vent hole (not shown) to allow air entry but to discourage water leakage to prevent a vacuum from being formed in tank 33. Tank-to-pump tube 39 is connected to pump 45 and includes one-way valve 41 which permits water to enter into pump cylinder 47, but not back into tank 33. Movement of the piston 57 within the pump cylinder 47 forces movement of water to bladder 13 from tank 33. The piston 57 is operated by the pump rod 59 that connects the piston 57 to the slider handle 55. The pump rod 59 is anchored to the slider handle 55 and is slideably held in place by block 61.

The slider handle 55 is operated manually by the user. The user holds the slider handle 55 with one hand and the gun handle 5 with the other. The slider handle 55 is then moved back and forth along the length of its path, with block 61 acting as a stop. The back and forth action is transferred to the piston 57, which draws water from tank 33 through tubing 39 and past one-way flow valve 41, into cylinder 47 on the outward stroke. On the inward stroke, water in cylinder 47 is forced (or pumped) through tubing 27, through "y" connection 25, into tubing 21 and into the bladder 13 for expansion and filling thereof. Water is pumped to the bladder 13 via pump 45 until the bladder 13 is filled. Water will also enter tube 29, but will not eject through the outlet tubing 65 and nozzle 11 because release valve 31 will be closed until trigger 7 is pulled. Once under expansion, the water in bladder 13 is prevented from flowing freely through the outlet tubing 65 by valve 31.

Figure 3:
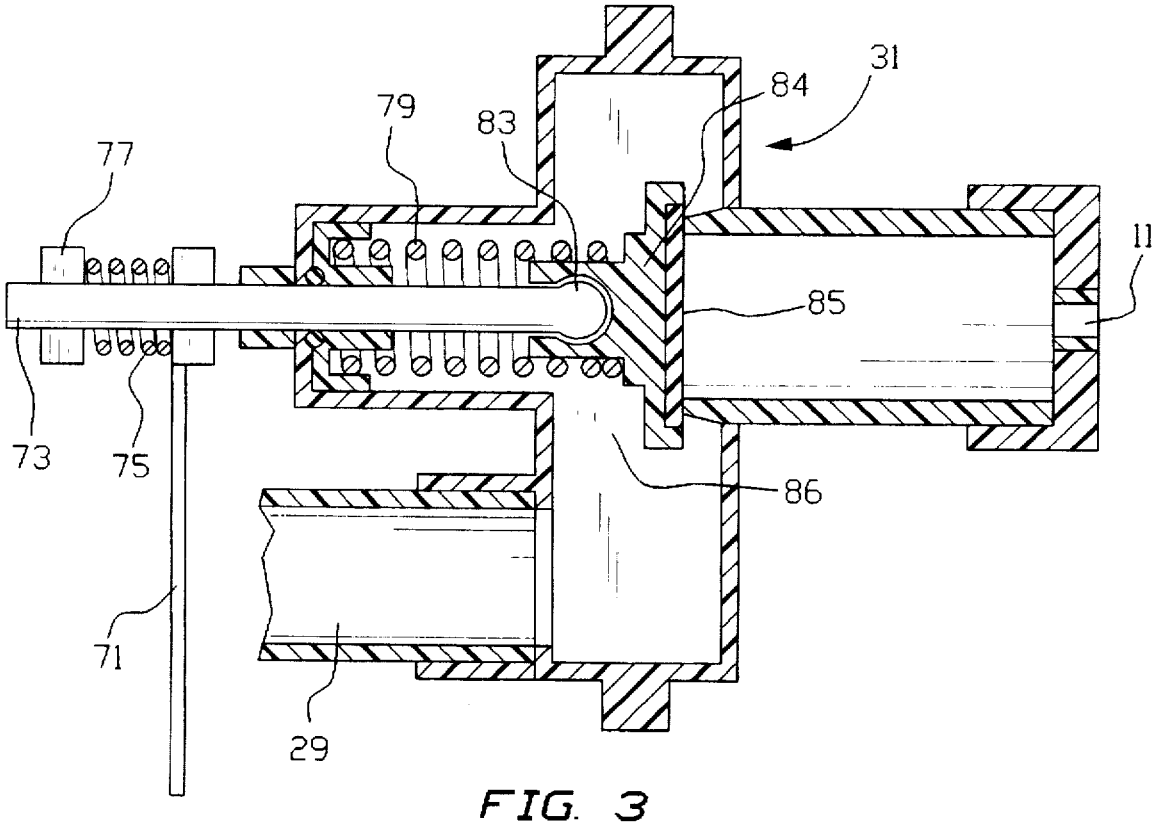
FIG. 3 shows a side cut view of a bladder release valve which may be used in the present invention toy water gun.

Referring now to FIG. 3, taken in conjunction with FIGS. 1 and 2 with identical parts being identically numbered, details of release valve 31 are shown in a side cut view. Linkage trigger riser 71 is connected to trigger 7 via linkage 72 (FIGS. 1 and 2) and is slidably attached to pull rod 73. Spring 75 and stop 77 work in conjunction with trigger riser 71. Stop 77 is securely attached to pull rod 73. Pull rod 73 has at its opposite end a flexible connection universal ball connector 83. This is slightly rotatable within valve plug 84. When the trigger 7 is pulled, linkage 72 causes trigger riser 71 to compress spring 75 to the left and pushes on stop 77 to move pull rod 73 and valve plug 84 with valve seal 85 to the left. However, spring 79 and water pressure within chamber 86 apply forces which tend to maintain valve plug 84 and valve seal 85 in the closed, sealed position. When sufficient squeeze pressure is applied to the trigger, spring 75 pushes stop 77 to the left, thereby, valve plug 84 and valve seal 85 are snapped to the left for rapid release and ejection of water motivated by compressive forces of the water-filled bladder 13. This creates the desired blasting effect and enhances the rate and distance of the ejected water.

Figure 4:
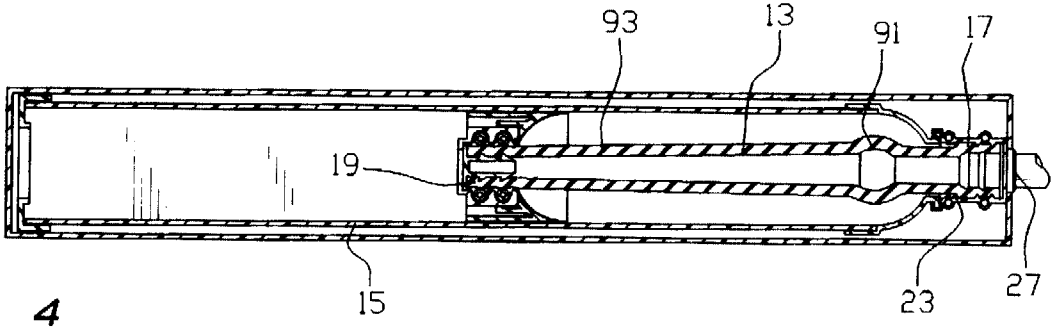
FIGS. 4 through 6 show partial side cut views of an enclosure and bladder for a present invention toy water gun wherein the bladder is shown in various expansion stages.
Figure 5:
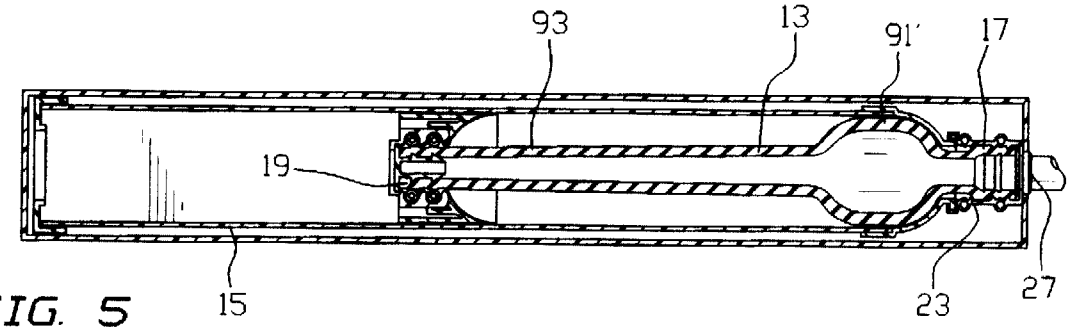
Figure 6:
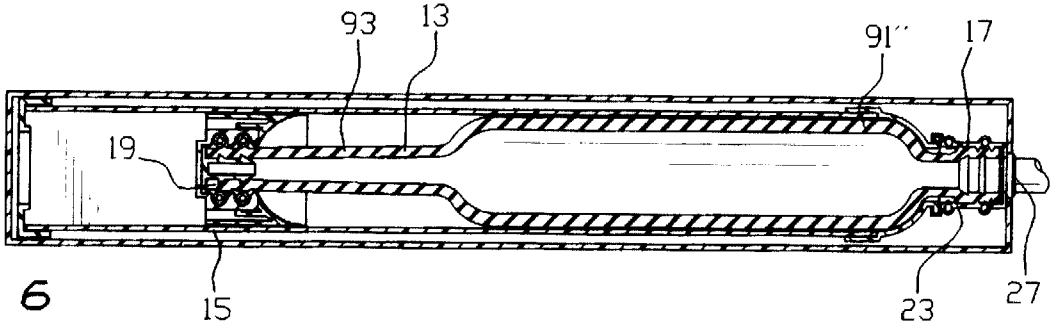

FIGS. 4 through 6 show side, partially cut, simplified views of a present invention toy water gun bladder 13 in various states of expansion. In this preferred embodiment arrangement, the bladder 13 has a predetermined inflated size and enclosure 15 has a size less than that predetermined fully expanded size.

In FIG. 4, bladder 13 is shown in its rest (unfilled, unexpanded) position, with identical parts being identically numbered, but with more bladder 13 detail shown. The bladder 13 includes a preformed "bubble" portion 91, which is weaker than the rest of the bladder and thus enhances expansion at that location. The bladder 13 preferably includes wall 93 which is tapered in the unexpanded state, with the wall having a smaller diameter towards back end 19 and a larger diameter towards bubble 91 and front end 17. The smaller diameter section requires more pressure to expand than the larger diameter section. Thus, expansion starts at the bubble 91 and progresses towards the back end 19. The bladder 13 first expands radially and then expands longitudinally to provide a more constant rate of flow when released.

Enclosure 15 acts as a bladder guide and limits expansion of the bladder 13 to prevent bursting and to support water weight. The enclosure 15 may be described relative to air pressurization of the bladder. For example, in the preferred embodiment, the bladder 15's uninflated diameter may be three quarters of an inch, and fully inflated with 25 psig, it may have a four inch diameter. The total size or volume of the bladder is based on the bladder length. Enclosure 15 may have a diameter of, for example, three and one half inches. This enclosure restricts over expansion and helps to cause expansion and release to occur with consistency. Thus, in FIG. 4, bladder 13 is at rest. In FIG. 5, there is water pressure applied to cause initial expansion. This is created by the force of pump 45 pushing water into the bladder 13. First, bubble 91 is expanded as bubble 91', shown in FIG. 5, and expansion occurs first at the outlet end 17 and does so radially. Next, as more water is added, the bladder 13 will expand laterally down the enclosure 15 at a fixed pressure and rate, as shown as expanded portion 91" in FIG. 6. Likewise, the contraction of the bladder 13 will cause the release of water, and at a relatively constant pressure for a constant rate of ejection will be achieved.

Figure 7:
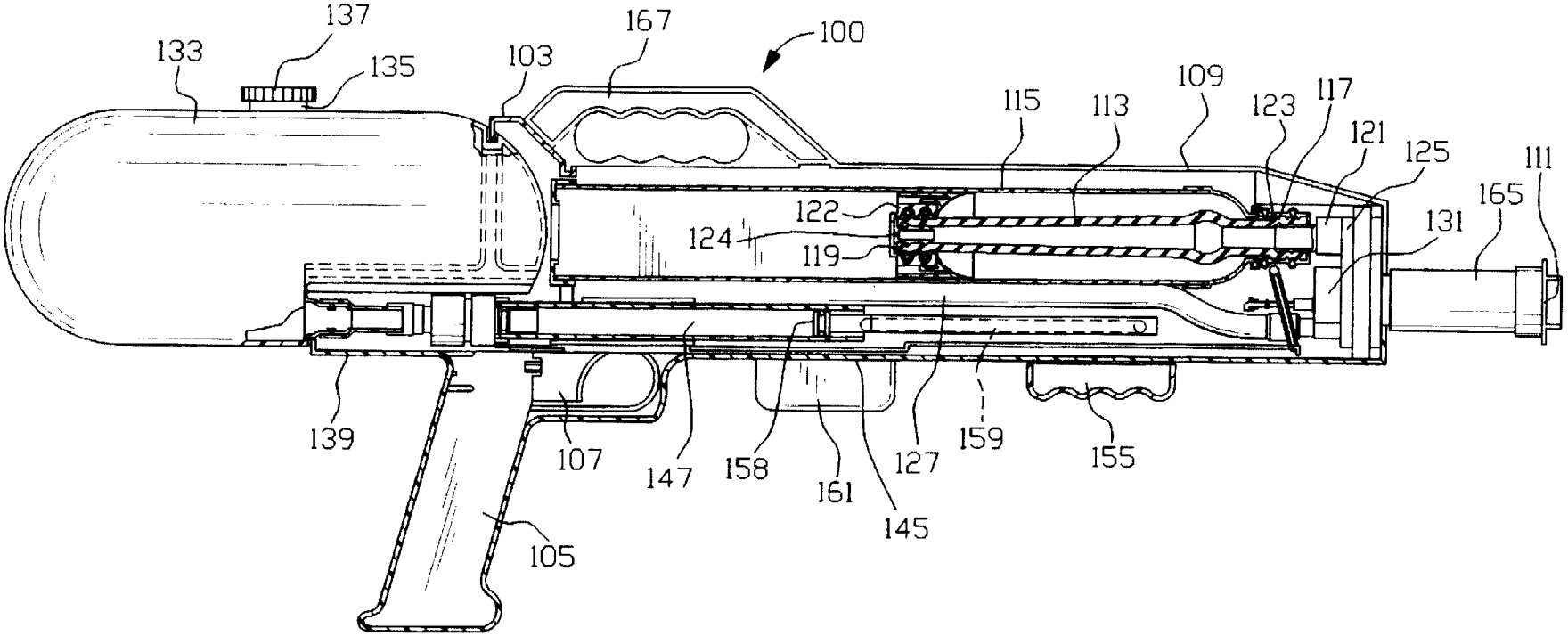
FIG. 7 shows a side cut view of an alternative embodiment present invention toy water shotgun.

FIG. 7 is a side view of another embodiment of a toy water gun 101 in accordance with the present invention. The toy water gun 101 is similar to the first embodiment and includes main housing 103, handle 105, trigger 107 and barrel 109 with nozzle 111. In this embodiment, nozzle 111 is circular and has an opening of about seven sixteenth of an inch in diameter.

Bladder 113 is located within enclosure 115. Bladder 113 has a front end 117.and back end 119 and is generally cylindrical, but could be of another shape and not exceed the scope of the present invention. Front end 117 acts both as an inlet and an outlet in this embodiment, but the water gun could be configured so that back end 119 acts as the outlet or vice versa. Back end 119 includes clamp 122 which holds plug 124 in the back end 119 of bladder 113, and also includes bladder carriage 120 surrounding and connected to clamp 122. Bladder carriage 120 moves towards the back of the gun as bladder 113 is expanded (filled) and moves back to its rest position (shown in FIG. 7) during release of the bladder. Front end 117 has tube 121 connected thereto via clamp 123. Tube 121 is connected to chamber 125 which is connected to tube 127, which is connected to a pump, described below. Chamber 125 is also connected to and contains a bladder release valve 131, discussed below.

Figure 8:
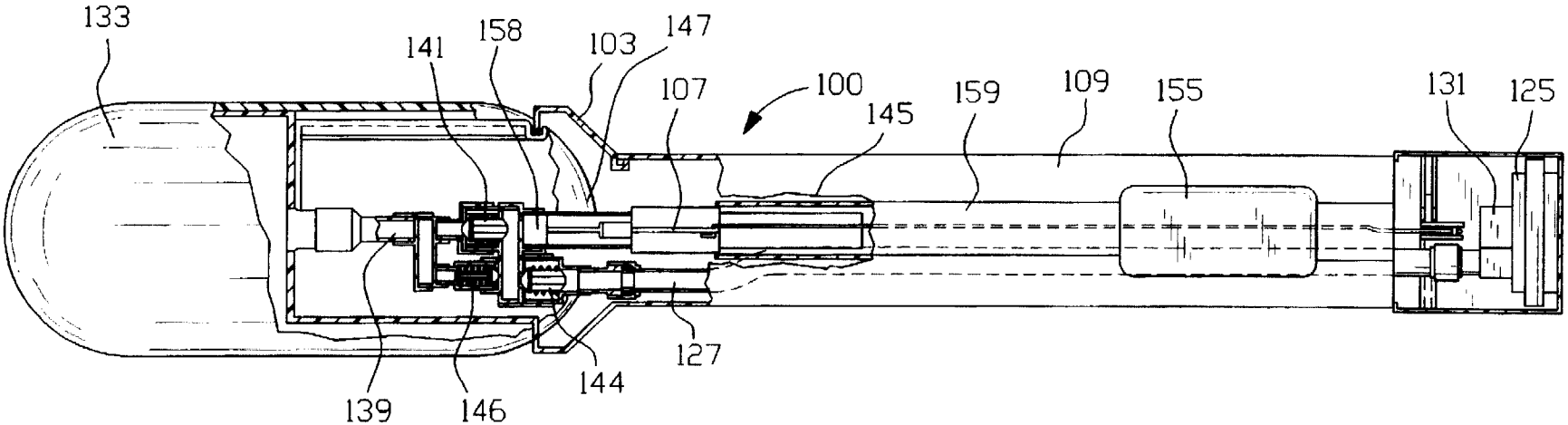
FIG. 8 shows a partial, bottom cut view of the present invention toy water gun shown in FIG. 7 with the bladder removed for presentation of the pump valve arrangement; and, FIG. 9 shows a side cut view of a bladder release valve of the present invention toy water shotgun shown in FIGS. 7 and 8.

The operation of present invention toy water gun 101 is illustrated by reference to both FIGS. 7 and 8 simultaneously, with identical parts for both figures being identically numbered. FIG. 8 shows a partial, cut, bottom view, with the bladder 113 and related housing removed to show pump not in FIG. 7 or 8 and valving arrangement. Toy water gun 101 is operated by filling or partially filling tank 133 with water through fill port 135 after removal of cap 137. Cap 137 has a small vent hole (not shown) to allow air entry but to discourage water leakage to prevent a vacuum from being formed in tank 133. Tank-to-pump tube 139 is connected to pump 145 and includes one-way valve 141 which permits water to be drawn into pump cylinder 147, but not back into tank 133. Movement of the piston 158 within the pump cylinder 147 permits movement of water to bladder 113 from tank 133. The piston 158 is operated by the pump rod 159 that connects the piston 158 to the slider handle 155. The slider handle 155 is operated manually by the user. The user holds the slider handle 155 with one hand and the gun handle 105 or the top handle 167 with the other. The slider handle 155 is then moved back and forth along the length of its path. The back and forth action is transferred to the piston 158, which draws water from tank 133 through tubing 139 and past one-way flow valve 141, into cylinder 147 on the outward stroke. On the inward stroke, water in cylinder 147 is forced past one-way valve 144 and into chamber 125, into tubing 121 and into the bladder 113 for expansion and filling thereof. Water will not eject through nozzle 111 because release valve 131 will be closed until trigger 107 is pulled. Water is pumped to the bladder 113 via pump 145 until the bladder 113 is filled. Pressure release valve 146 prevents overpumping to bladder 113 by opening and allowing water to pass from the pump 145 back to the tubing 139 and the tank 133 once a predetermined pressure is achieved. Once under expansion, the water in bladder 113 is prevented from flowing freely through the outlet tubing 165 to nozzle 111 by valve 131.

Figure 9:
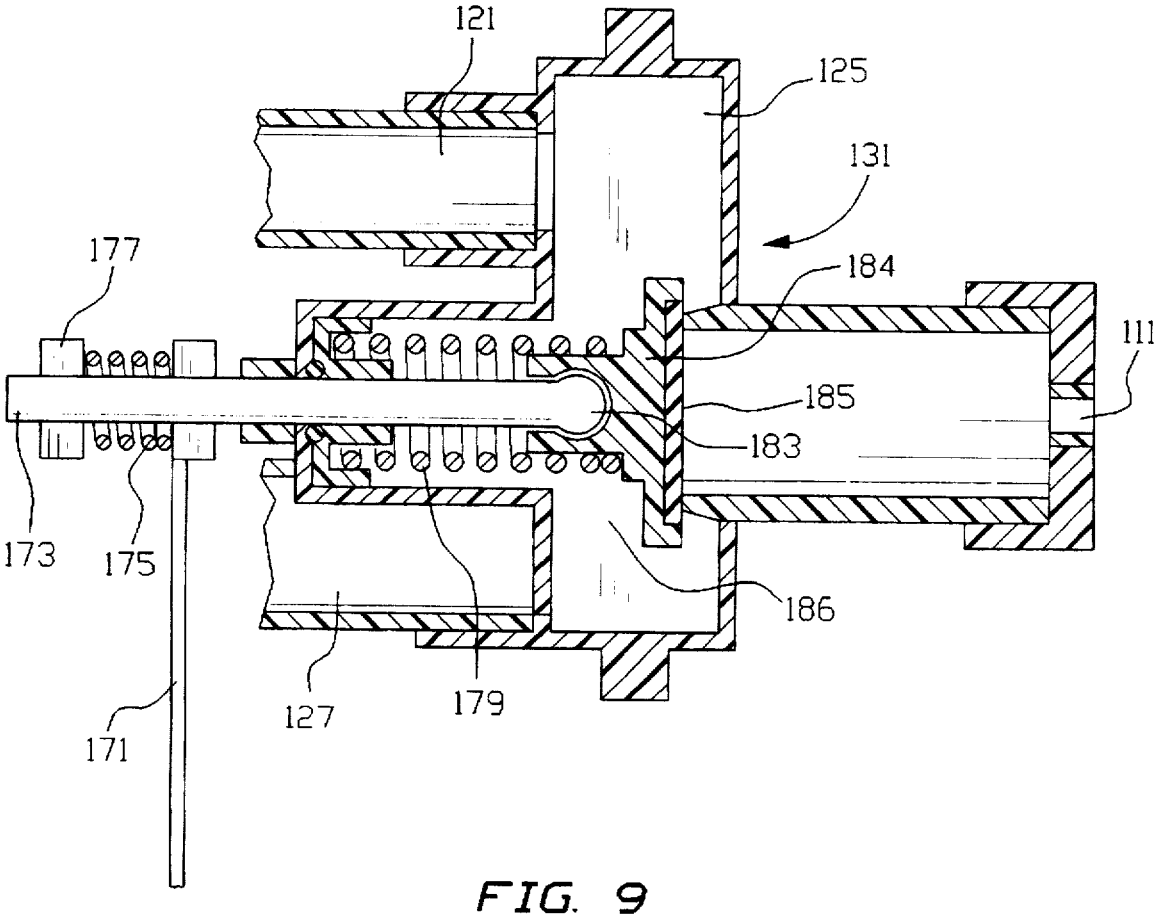

Referring now to FIG. 9, taken in conjunction with FIGS. 7 and 8 with identical parts being identically numbered, details of chamber 125 with release valve 131 are shown in a side cut view. Linkage trigger riser 171 is connected to trigger 107 via linkage 172 (FIG. 7) and is slidably attached to pull rod 173. Spring 175 and stop 177 work in conjunction with trigger riser 171. Stop 177 is permanently attached to pull rod 173. Pull rod 173 has at its opposite end a flexible connection universal ball connector 183. This is slightly rotatable within valve plug 184. When the trigger 107 is pulled, trigger riser 171 compresses spring 175 to the left and pushes stop 177 to move pull rod 173 and valve plug 184 with valve seal 185. When sufficient squeeze pressure is applied to the trigger, spring 75 pushes stop 77 to the left, thereby, valve plug 84 and valve seal 85 and are snapped to the left for rapid release and ejection of water motivated by compressive forces of the water-filled bladder 13. This creates the desired blasting effect and enhances the rate and distance of the ejected water. In some embodiments, the springs 175 and 179 are balanced so that once valve seal 185 is opened, it does not close until the internal pressure is close to zero. This maintains a single, quick, shotgun blast.

It should now be recognized that preferred embodiments toy water guns of the present invention having the enclosure about the bladder, will allow for repeat shots with the same burst of water and thus consistency in firing, until the bladder is substantially fully deflated.

Obviously, numerous modifications and variations of the present invention are possible in light of the above teachings. It is therefore understood that within the scope of the appended claims, the invention may be practiced otherwise than as specifically described herein.

What is claimed is:

1. An expandable bladder toy water gun, which comprises:

(a) a main housing having a barrel, a nozzle, a handle and a trigger located thereon;

(b) an expandable bladder connected to said main housing, said bladder having an inlet and an outlet;

(c) a water storage tank connected to said water gun and having an outlet connected to a pump;

(d) a pump for pumping water from said tank to said bladder to expand and fill said bladder with water, resulting in an expanded bladder, wherein said expanded bladder provides a motive force for ejection of water from said toy water gun, said pump being physically connected to said housing and being functionally connected to said bladder inlet and said tank, said pump having sufficient pumping pressure to expand said bladder upon pumping water thereto, said pump having a one-way valve to permit pumping from said tank to said bladder; and, (e) a bladder release valve having an upstream side and a downstream side, and being connected to said bladder outlet at said valve's upstream side, and being connected to said trigger for opening and closing thereof, and being functionally connected to a nozzle for ejection of water at said valve's downstream side upon release of at least a portion of said expanded bladder, said valve having a first, closed position to maintain expanded bladder water containment, and a second, open position to effect bladder release.

2. The toy water gun of claim 1 wherein said bladder release valve is normally in its first, closed position and is moved to its second, open position by trigger activation.

3. The toy water gun of claim 2 wherein said bladder release valve is connected to a spring and is spring biased to its first, closed position, whereby a snap-action release occurs to snap said bladder release valve to its second, open position when said trigger is activated and overcomes said spring.

4. The toy water gun of claim 1 wherein said pump is a piston chamber pump with a slider.

5. The toy water gun of claim 4 wherein said pump is a one way pumping mechanism including a first one way valve which permits pressurization towards said bladder and prevents water from escaping from said pump away from said bladder.

6. The toy water gun of claim 1 wherein said pump is attached to said main housing below said barrel.

7. The toy water gun of claim 1 wherein said bladder has a first end and a second end and said first end has a single orifice which constitutes both said bladder inlet and said bladder outlet.

8. The toy water gun of claim 1 wherein said pump is connected to said bladder inlet via a single flow path, said single flow path also being connected to said bladder release valve whereby said single flow path functions both for pumping water into said bladder in conjunction with said pump and for releasing water from said bladder in conjunction with said bladder release valve and trigger.

9. The toy water gun of claim 1 wherein said expandable bladder has a larger diameter longitudinal section located in proximity to said bladder inlet to enhance expansion of said bladder first radially and, second, longitudinally, upon being filled with water.

10. The toy water gun of claim 1 wherein said expandable bladder has a bladder wall with a constant predetermined thickness, the bladder being tapered so that said inlet end is larger in diameter than an opposite end to enhance expansion of said bladder first at said inlet end radially and, second, longitudinally, upon being filled with water.

11. The toy water gun of claim 1 wherein said expandable bladder has a predetermined wall thickness at its first end, an increasing wall thickness being tapered from said first end to said second end, and having a predetermined wall thickness at said second end which is greater than said predetermined wall thickness at said first end.

12. The toy water gun of claim 11 wherein said expandable bladder has a substantially constant inside diameter.

13. The toy water gun of claim 1 wherein said nozzle has an apparent diameter of at least one eighth of an inch to effect massive, fast burst firing.

14. The toy water gun of claim 13 wherein said nozzle has an apparent diameter of at least one quarter inch.

15. An expandable bladder toy water gun which comprises:

(a) a main housing having a barrel, a nozzle, a handle and a trigger located thereon;

(b) an expandable bladder connected to said main housing, said bladder having an inlet and an outlet;

(c) a water storage tank connected to said water gun and having an outlet connected to a pump;

(d) a pump for pumping water from said tank to said bladder to expand and fill said bladder with water, resulting in an expanded bladder, wherein said expanded bladder provides a motive force for ejection of water from said toy water gun, said pump being physically connected to said housing and being functionally connected to said bladder inlet and said tank, said pump having sufficient pumping pressure to expand said bladder upon pumping water thereto, said pump having a one-way valve to permit pumping from said tank to said bladder;

(e) a bladder release valve having an upstream side and a downstream side, and being connected to said bladder outlet at said valve's upstream side, and being functionally connected to said trigger for opening and closing thereof, and being connected to a nozzle for ejection of water at said valve's downstream side upon release of at least a portion of said expanded bladder, said valve having a first, closed position to maintain expanded bladder water containment, and a second, open position to effect bladder release; and, (f) said bladder having a predetermined expansion size to which it is capable of being expanded, and an enclosure provided around said bladder, said enclosure being of a size less than said predetermined expansion size to enhance a controlled expansion of said bladder during pumping and filling.

16. The toy water gun of claim 15 wherein said bladder release valve is normally in its first, closed position and is moved to its second, open position by trigger activation.

17. The toy water gun of claim 15 wherein said bladder release valve is connected to a spring and is spring biased to its first, closed position, whereby a snap-action release occurs to snap said bladder release valve to its second, open position when said trigger is activated and overcomes said spring and internal pressure.

18. The toy water gun of claim 15 wherein said pump includes a piston and a slider.

19. The toy water gun of claim 18 wherein said pump is a one way pumping mechanism including a first one way valve which permits pressurization towards said bladder and prevents water from escaping from said pump away from said bladder.

20. The toy water gun of claim 15 wherein said pump is attached to said main housing below said barrel.

21. The toy water gun of claim 15 wherein said bladder has a first end and a second end and said first end has a single orifice which constitutes both said bladder inlet and said bladder outlet.

22. The toy water gun of claim 15 wherein said pump is connected to said bladder inlet via a single flow path, said single flow path also being connected to said bladder release valve whereby said single flow path functions both for pumping water into said bladder in conjunction with said pump and for releasing water from said bladder in conjunction with said bladder release valve and trigger.

23. The toy water gun of claim 15 wherein said expandable bladder has a weaker longitudinal section located in proximity to said bladder inlet to enhance expansion for said bladder first axially and, second, longitudinally, upon being filled with water.

24. The toy water gun of claim 15 wherein said expandable bladder has a bladder wall with a constant predetermined thickness, the bladder being tapered so that said inlet end is larger in diameter than an opposite end to enhance expansion of said bladder first at said inlet end radially and, second, longitudinally, upon being filled with water.

25. The toy water gun of claim 15 wherein said expandable bladder has a predetermined wall thickness at its first end, an increasing wall thickness being tapered from said first end to said second end, and having a predetermined wall thickness at said second end which is greater than said predetermined wall thickness at said first end.

26. The toy water gun of claim 25 wherein said expandable bladder has a substantially constant inside diameter.

27. The toy water gun of claim 15 wherein said nozzle has an apparent diameter of at least one eighth of an inch to effect massive, fast burst firing.

28. The toy water gun of claim 27 wherein said nozzle has an apparent diameter of at least one quarter inch.

* * * * *